United States Patent [19]

Havlik et al.

[11] 4,187,167

[45] Feb. 5, 1980

[54] METHOD AND APPARATUS FOR THE EXTRACTION AND RECOVERY OF HYDROCARBONS FROM PETROLEUM BEARING MATERIALS

[76] Inventors: Jaroslav Havlik, 695 Bishop St., Cambridge, Ontario, Canada, N3H 4V2; William E. Hodges, 100 Front St. West, Toronto, Ontario, Canada

[21] Appl. No.: 905,233

[22] Filed: May 12, 1978

[51] Int. Cl.[2] ..... C10B 1/08; C10G 1/02

[52] U.S. Cl. ..... 208/8 R; 201/7; 201/32; 202/119; 202/128; 208/11 R

[58] Field of Search ..... 208/8, 11 R; 201/7, 201/33, 32; 202/119, 128

[56] References Cited

U.S. PATENT DOCUMENTS

| | | | |
|---|---|---|---|
| 1,423,527 | 7/1922 | Johns | 208/11 R |
| 2,560,767 | 7/1951 | Huff | 208/11 R |
| 3,112,255 | 11/1963 | Campion | 208/11R |
| 3,432,397 | 3/1969 | Berg | 208/11 R |
| 3,560,347 | 2/1971 | Knapp et al. | 208/8 R |
| 4,094,769 | 6/1978 | Brown | 208/11 R |

*Primary Examiner*—Herbert Levine
*Attorney, Agent, or Firm*—George H. Riches and Associates

[57] ABSTRACT

The invention relates to a method and apparatus for the extraction of petroleum from tar sands, bituminous shale, and other petroleum bearing materials, and the separation of the extracted petroleum into its several fractions. The process consists essentially of chopping the material to break it into a finely divided particulate and homogeneous mass; depositing the material as a finely divided particulate homogeneous mass on linearly spaced flat reciprocating transporters housed within a vaporizing chamber having one inlet at one end and a discharge at the other, including the step of metering the material as it is deposited on the transporters; transporting the material through a vaporizing zone in direct contact with the transporters which are made of electrically heatable material, electrically heating the transporters to thereby heat the petroleum bearing material as it is transported through the vaporizing zone to vaporize the corresponding component of the petroleum and then recovering the said corresponding vaporized component of the petroleum as a distinct condensate. Even though, the vaporizing zone may be singular, it may be, if desired, divided into a plurality of vaporizing zones, corresponding to the number of hydrocarbon fractions which it is desired to separately collect in a substantially pure state. In the case of a series of vaporizing zones, the temperature to which the material is raised in each chamber is that at which the particular fraction to be recovered is vaporized.

15 Claims, 6 Drawing Figures

METHOD AND APPARATUS FOR THE EXTRACTION AND RECOVERY OF HYDROCARBONS FROM PETROLEUM BEARING MATERIALS

PRIOR ART

A number of methods have already been proposed for the recovery of petroleum from bituminous tar sands which are found extensively in Alberta, Canada and other parts of the world. One such method has been to remove the petroleum from the bituminous tar sand by washing the sand, using steam in water and detergent and then subsequently recovering the petroleum from the water. This method requires large amounts of energy.

Another method is described in U.S. Pat. No. 3,518,181 dated June 30, 1970 to R. F. TSE entitled "Pyrolytic Methods of Treating Bituminous Tar Sands and the Preheating of the Same." This process essentially consists of feeding the tar sands to a preheat zone, then to a thermal cracking zone where the vaporized hydrocarbons are recovered, the residue being delivered to a decoking zone or alternatively a stripping zone to burn off the residue carbonaceous material and recycling the hot gases; the spent sand being recovered separately.

OUTLINE OF THE INVENTION

The method and apparatus of the present invention, in its simplest form, comprises essentially a preparation zone, where the tar sand is ground into small pieces. If desired, the sand may be preheated to about 100° F. in the preparation zone. The sand is then fed through an extraction or vaporizing zone, as a substantially finely divided particulate homogeneous mass in the form of a thin layer, preferably ½" to 1" thick. The thin layer is deposited on inclined reciprocatable transporters which move the material progressively through the extraction zone at the appropriate speed. The transporters are linearly spaced and formed of magnetic electrically susceptible material, i.e., material that can be heated by magnetic induction. The transporters are reciprocatably supported on fixed transporters. The fixed transporters are also linearly spaced and mounted below the reciprocatable transporters. As the petroleum consists of several hydrocarbon fractions having distinct and different vaporizing temperatures, the extraction zone is divided into a plurality of vaporizing chambers corresponding in number to the total number of fractions to be recovered. A transporter is provided for moving the material through each vaporizing zone. Each transporter is separately and accurately heated, preferably, by magnetic induction to the specific vaporizing temperature of the material moving therethrough. If the tar sands bear a petroleum product having six different hydrocarbons, each having a different vaporizing temperature, there can be provided, if desired, six vaporizing chambers, each chamber having a transporter, which is accurately heated to the correct vaporizing temperature, the first vaporizing zone having the lowest temperature. Thus, hydrocarbons having the lowest vaporization temperature will be extracted in the first vaporizing chamber and from then on the petroleum bearing material will be transported, step-by-step, through progressively higher temperatures in each vaporizing chamber until all the petroleum products are recovered from the petroleum bearing material. The dry material is recovered at the end.

The vaporized petroleum products are collected and then condensed. The condensate can be then subsequently separated into its several fractions by any of the known processes. In the other embodiment of the invention, the six vaporizing chambers are isolated from each other so that the vapors generated in each chamber can be collected separately and recovered separately by condensation. The petroleum is thus separated, in a substantially pure state, into its fundamental fractions, e.g., hydrocarbon gases, light distillates, intermediate distillate, lubricating oil distillate, residues and refinery sludge.

In the following description, there are described preferred embodiments of the method and apparatus which are set forth for the purpose of illustrating the invention. However, it is to be understood, that the present invention is not restricted to the specific method or apparatus disclosed since it will be apparent to persons skilled in this art that modifications can be made without departing from the invention.

It will also be evident that the method and apparatus of this invention is useful for the purpose of separating petroleum from bituminous bearing shale, contaminates, foreign bodies, etc. in addition to the bituminous bearing sands described herein, e.g., the tar sands of the Athabaska region of Alberta, Canada.

The accompanying drawings illustrate the construction and operation of the method and apparatus wherein.

Figures 1, 2:
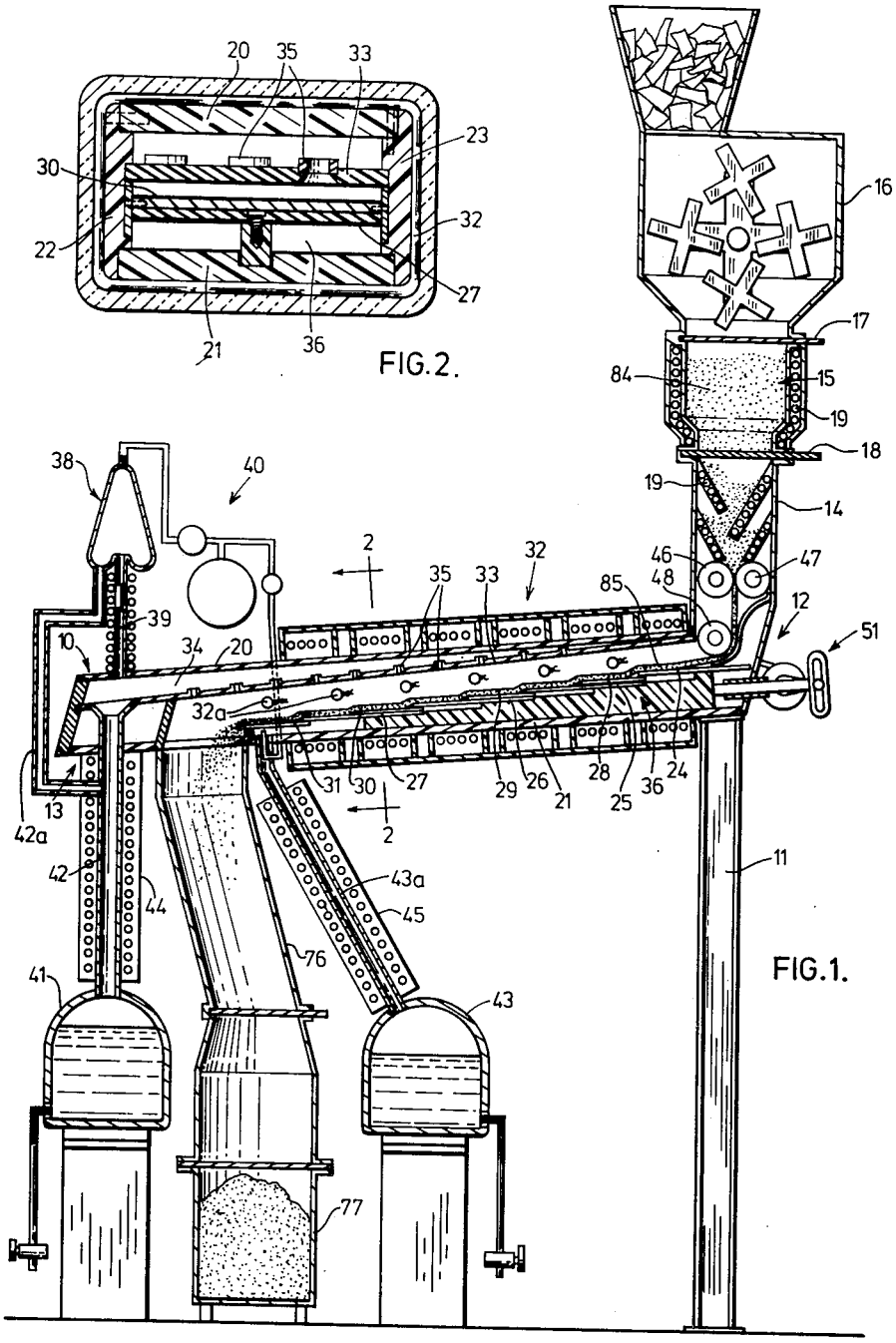
FIG. 1 is a vertical cross-section of an apparatus, diagrammatically illustrating a machine for carrying out the method of this invention.
FIG. 2 is a cross-section on the line 2—2 of FIG. 1.
Figures 3, 4:
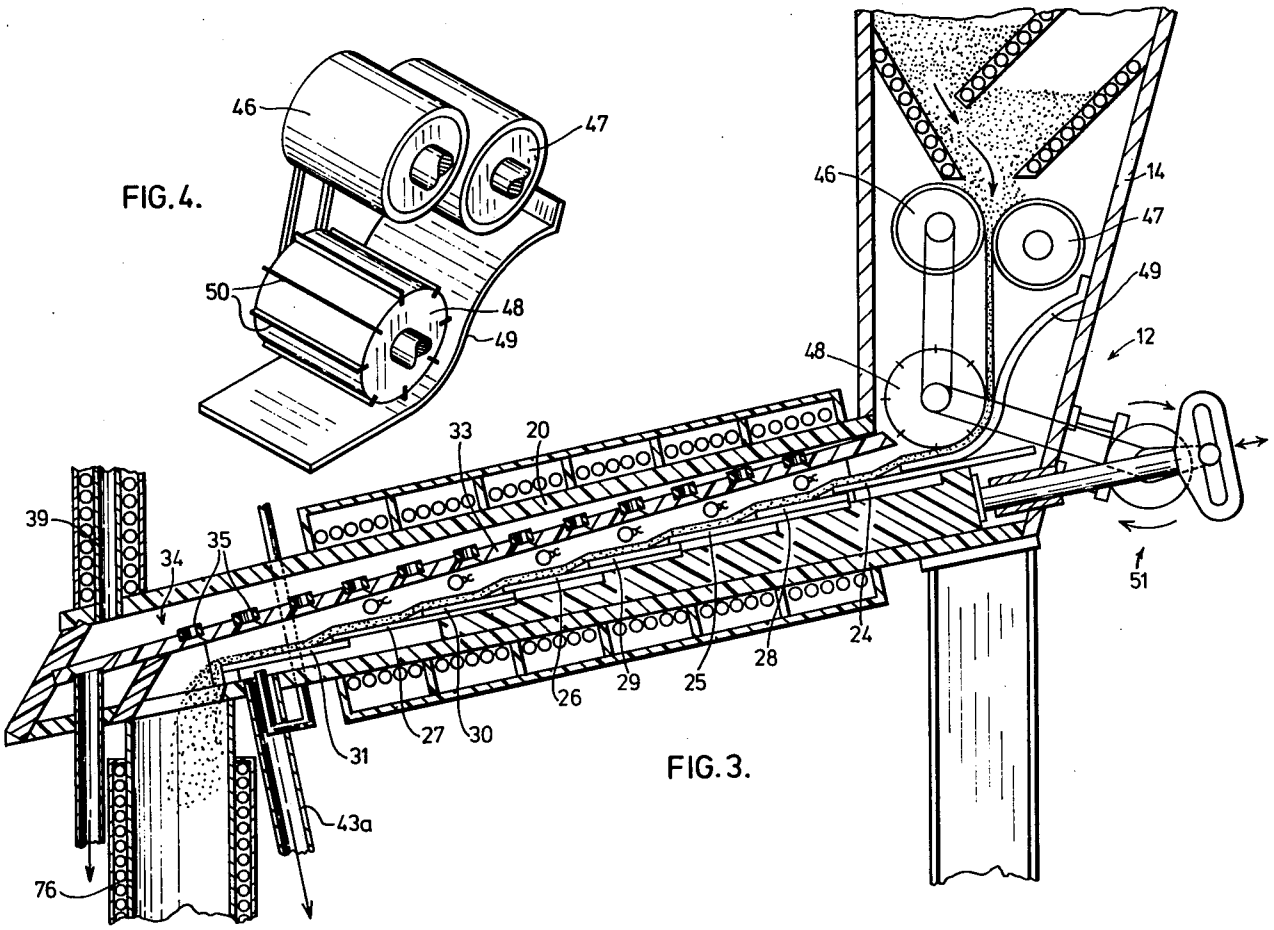
FIG. 3 is a fragmentary view of the structure illustrated in FIG. 1, to show the transporters on an enlarged scale.
FIG. 4 is a perspective view of the sizing means.

Referring first, FIGS. 1 through 5 illustrate an apparatus suitable for extracting and recovering the hydrocarbons of bituminous sands, such as the kind mined in Alberta, Canada. The apparatus consists of an elongated, rectangular casing 10 which is suitably supported by a framework (not shown in detail) which includes the leg 11. The casing is inclined downwardly at an angle, preferrably of 15°-25°. The inlet end of the casing is generally indicated by the number 12 and the discharge end by the number 13. The inlet end 12, as will be seen in the drawings, is at a higher elevation than the discharge end 13. Mounted on the inlet end 12 and extending upwardly therefrom, is the metering chamber 14. Above the metering chamber 14, and in communication therewith, is a storage compartment 15 which holds a supply of the sand indicated by number 84. Mounted on top of the storage compartment 15 and communicating therewith is a chopper 16. In the passage between the chopper 16 and bin 15 is a valve mechanism 17 and the passage between the bin and the metering chamber is a valve mechanism 18. The purpose of these will be described with the description of the operation of the extraction operation. The material in the bin and the metering can be preheated by any suitable heating means such as electric heating elements or waste heat from the extracting method. The heating means is indicated by the number 19.

Figure 5:
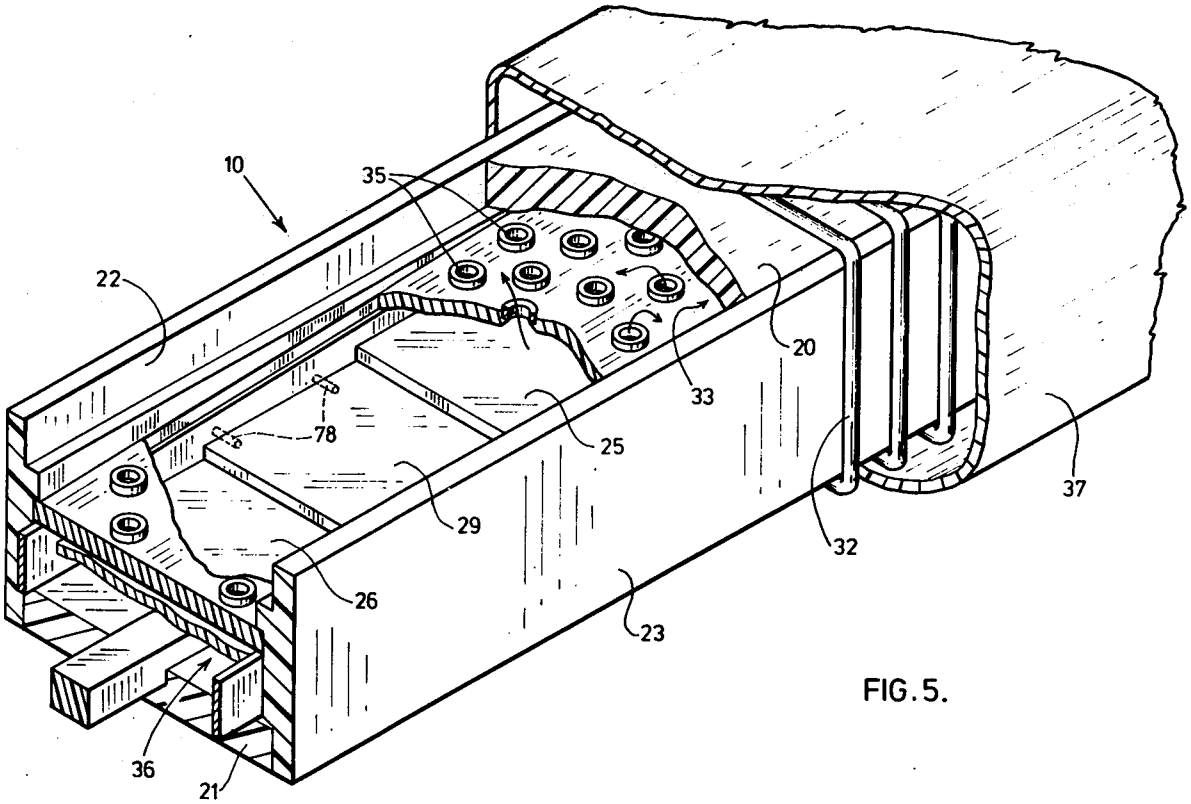
FIG. 5 is a perspective showing, on an enlarged scale, a vaporizing chamber and its related parts.

The casing 10 is made, preferrably, of transite which is not magnetic-electrically susceptible, and consists of a top wall 20, bottom wall 21, and side walls 22,23. The casing 10 houses the transporting mechanism which consists, in the present illustration, of four reciprocatable transporters 24, 25, 26, 27 linearly spaced and supported on fixed transporters 28, 29, 30, 31 which are supported by the side walls 22,23 of the casing 10 as shown in FIG. 5, the fixed transporters being secured to the respective side walls 22,23 by pins 78 (FIG. 5).

The transporters are made of magnetic-electrically susceptible material that can be heated by electric induction. The reciprocatable transporters are operatively connected to a drive mechanism generally indicated at 51, which mechanism is constructed to continuously reciprocate the reciprocatable transporters at the appropriate speed. The reciprocatable transporters, in the present embodiment, have a stroke about 4½". The casing, in the area of the transporters, is surrounded by electromagnetic heating coils 32 which heat each of the transporters, herein sometimes referred to as electromagnetic heating means, by the transfer of energy through the magnetic component of an oscillating mid-to-high frequency electro-magnetic field. It has been considered unnecessary to show the electrical circuits and controls. The coils are enclosed within a protective shell. The coils are controlled by temperature sensors 32A, six in number in the present embodiment, to progressively heat the transporters from the lowest vaporizing temperature of the entrained hydrocarbons to the highest vaporizing temperature at the discharge end 13. Above the transporters is a partition 33, also made of material that is not magnetic-electrically susceptible, which extends longitudinally from inlet end 12 to the discharge end forming the top wall, a vapor collecting chamber 34 which is formed with a plurality of apertures 35 throughout its length through which the vaporized hydrocarbons pass into the gas collecting chamber 34. Below the transporters is secondary collecting chamber 36 for collecting vapors and hydrocarbon condensates. At the outlet end of casing 10 are the means for collecting the various products, namely a primary gas collector 38 which is connected by pipe 39 to the chamber 34. Associated with the collector 38 is a gas condensing unit 40. Vaper which condenses on partition 33 is collected in condensate collector 41 through pipe 42 which depends from the wall 33 at the discharge end 13. A pipe 42A connects collector 38 to the pipe 42 to drain off condensate that may form in collector 38. A secondary collector 43, below the casing 10 communicates with the secondary collecting chamber 36, adjacent the discharge end 13 through pipe 43*a* to remove condensate trapped in the secondary chamber. The condensate collector and secondary collector may be provided with cooling units 44,45 respectively.

The spent sand, i.e. the sand from the hydrocarbons, goes through a chute 76 having its entrance located to receive the spent sand from fixed transporter 31 which is the last transporter in the system. The sand feeds by gravity into a receptacle 77 which, when full, can be removed and replaced by an empty one.

The metering chamber 14 is provided with a pair of metering rollers 46,47 which continuously feed a measured amount of material being delivered to the extruding unit which consists of the feeding roller 48 and curved chute 49. A satisfactory speed of rotation of the metering rollers is from a maximum of 20 r.p.m. to a minimum of 16 r.p.m. and the feeding roller from 16 r.p.m. to 10 r.p.m. The feeding roller is provided with blades 50 (see FIG. 4) to ensure uniform feeding of the material to the first reciprocating transporter 24. The rollers are driven by a belt and pulley system from the drive mechanism 51.

The metering chamber 14 and storage chamber with the bituminous sand may be heated to a temperature below the lowest vaporizing temperature of the hydrocarbon being recovered.

Figure 6:
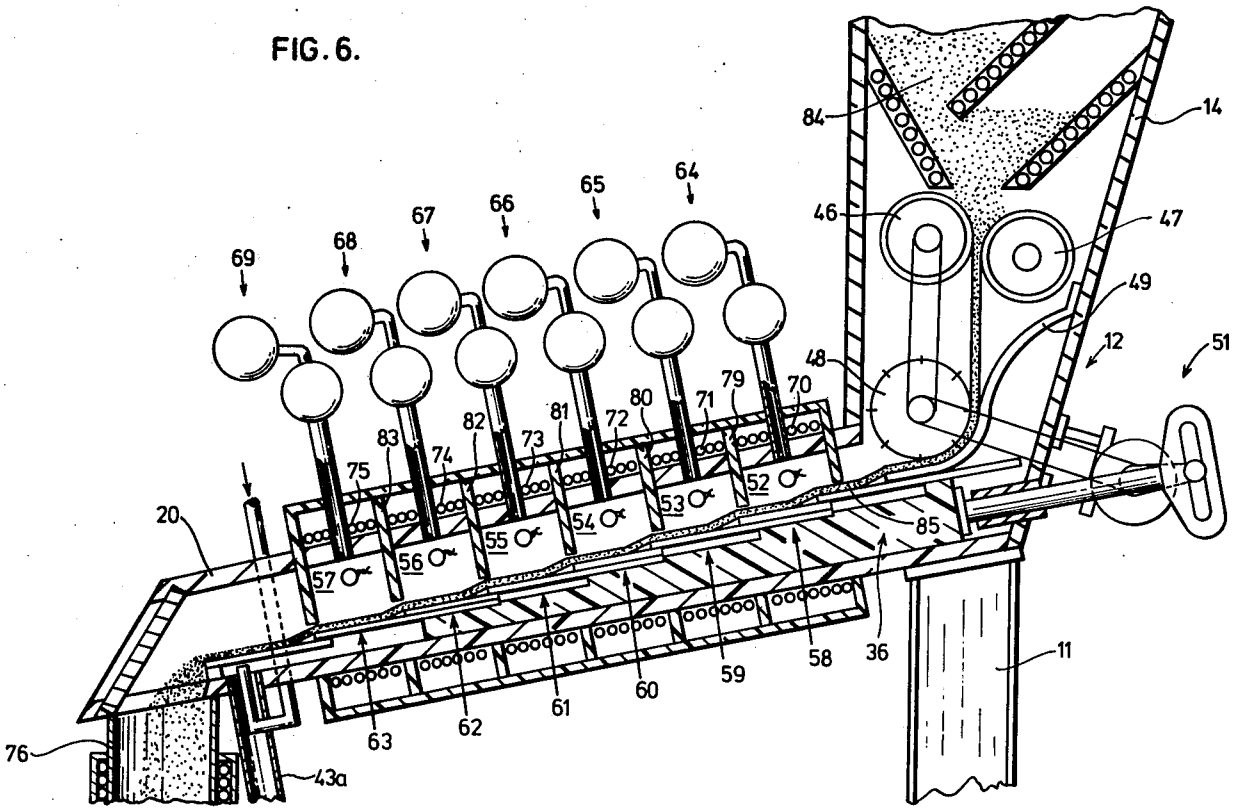
FIG. 6 is a vertical cross-section diagrammatically illustrating an apparatus for collecting six different fractions of hydrocarbons and recovering them separately.

The modification shown in FIG. 6 is constructed in the same manner as the apparatus shown in FIGS. 1 through 5 and will have the same reference numbers except where the differences occur. In this modification, the gas collecting chamber is divided into six sub-chambers 52, 53, 54, 55, 56 and 57 to correspond to the six hydrocarbon fractions. The transporters are divided into six separate groups, each one of which is heated by induction to the appropriate vaporizing temperature of the respective hydrocarbon namely the groups indicated by the numbers 58, 59, 60, 61, 62 and 63. The transporter groups 58, 59, 60, 61, 62 and 63 are located immediately below sub-chambers 52, 53, 54, 55, 56 and 57 respectively. The chambers are isolated from each other by barriers 79 through 83. The sub-chambers 52, 53, 54, 55, 56, and 57 are each connected to one of the gas collectors and condensing systems 64, 65, 66, 67, 68, and 69, respectively. The electro-magnetic heating means are divided into six sections 70, 71, 72, 73, 74 and 75, which are separated from each other by the barriers. They are each provided with a separate control (not shown) so that the temperature of each sub-chamber can be accurately controlled at the appropriate temperature so that the hydrocarbon fractions can be extracted and recovered separately. Of course, the lowest extraction temperature will be the transporter group 58 and each succeeding transporter group will be at progressively higher temperatures.

The apparatus operates in the following manner. The bituminous sand, straight from the mine, is dumped into the chopper 16 where it is broken up. The valve mechanisms 17 and 18 will be normally closed. If the bin 15 is empty, the valve mechanism 17 will automatically open and be filled with chopped material. When the metering chamber 14 requires refilling, the valve mechanism 18 automatically opens and the valve mechanism 17 remains closed. The material passes between metering rollers 46, 47, and thence to the feeding roller 48 and chute 49 to be deposited on the first reciprocating transporter 24 as a substantially thin layer of material indicated by the number 85. The transporters, as previously mentioned, are heated by electro-magnetic heating means to vaporize the hydrocarbons having the lowest vaporizing temperature. The speed of reciprocation is such that essentially all of the said hydrocarbons are progressively extracted. The reciprocation of the transporter 24 will move the material onto the fixed transporter 28 and thence, step-by-step through progressively higher temperatures until the several fractions of the hydrocarbons have been extracted. The gases rise into chamber 34 into collector 38 and condensor 40. Any liquid substance will drain into collectors 41, 43.

The method and apparatus illustrated in FIG. 6 operates in the same manner, except as indicated, namely that each of the six hydrocarbon fractions are collected separately, step-by-step, as produced, starting with the one having the lowest vaporizing temperature. Of course, if it is necessary to collect more than six fractions, the number of sub-chambers, transporter groups, induction heat units and collectors will be increased accordingly.

LIST OF PARTS

| | | | |
|---|---|---|---|
| 10 | Rectangular Casing | | |
| 11 | Leg | | |
| 12 | Inlet End | | |
| 13 | Discharge End | | |
| 14 | Metering chamber | | |
| 15 | Storage Compartment | | |
| 16 | Chopper | | |
| 17 | Valve Mechanism | | |
| 18 | Valve Mechanism | | |
| 19 | Heating means | | |
| 20 | Top Wall | | |
| 21 | Bottom Wall | | |
| 22 | Side Wall | | |
| 23 | Side Wall | | |
| 24, 25, 26, 27 | Reciprocatable Transporters | | |
| 28, 29, 30, 31 | Fixed Transporters | | |
| 32 | Electro Magnetic Coils | | |
| 32A | Heat Sensor | | |
| 33 | Partition | | |
| 34 | Vapor Collecting Chamber | | |
| 35 | Apertures | | |
| 36 | Secondary Collecting Chamber | | |
| 37 | Not Used | 64 | |
| 38 | Primary Gas Collector | 65 | Gas Collectors and Condensing Systems |
| 39 | Pipe | 66 | |
| 40 | Gas Condensing Unit | 67 | |
| 41 | Condensate Collector | 68 | |
| 42 | Pipe | 69 | |
| 42A | Pipe | 70 | Electro Magnetic Heating Means |
| 43 | Secondary Collector | 71 | |
| 44, 45 | Cooling Units | 72 | |
| | | 73 | |
| 46, 47 | Metering Rollers | 74 | |
| | | 75 | |
| 48 | Feeding Rollers | 76 | Chutes |
| 49 | Curved Chute | 77 | Receptacle |
| 50 | Blades | 78 | Pins |
| 51 | Drive Mechanism | 79 | Barriers |
| 52 | | 80 | |
| 53, 54 | Sub Chambers | 81 | |
| | | 82 | |
| 55 | | 83 | |
| 56 | | 84 | Sand |
| 57 | | 85 | Thin Layer of Material |
| 58, 59, 60, 61, 62, 63 | Transporter Groups | | |

What I claim is:

1. The method of recovering hydrocarbons from solid materials bearing petroleum, comprising the steps of:

(a) depositing the material as a finely divided particulate homogeneous mass on linearly spaced flat reciprocating transporters housed within a vaporizing chamber having an inlet at one end and a discharge outlet at the other, including the step of metering the material as it is deposited on the transporter;

(b) transporting the deposited material through the vaporizing chamber from the inlet end to the outlet end in direct contact with the reciprocating transporters made from magnetic-electrically susceptible material able to absorb energy from the magnetic component of an electro-magnetic field through the phenomena of electric induction and transform thereby such energy to thermal heat to heat the transporters and thereby heat the said thin layer of material in direct physical contact with the surface of the said transporter to the vaporizing temperature;

(c) heating the transporters by electrical energy to thereby effectively uniformly heat the thin layer of material to the vaporizing temperature of the hydrocarbons during the transportation of the materials therethrough;

(d) controlling the temperature of the transporters the speed of travel of the said material through the vaporizing chamber to vaporize substantially all of the desired hydrocarbons; and (e) recovering the vaporized hydrocarbons.

2. The method of recovering hydrocarbons from solid materials bearing petroleum, comprising the steps of:

(a) introducing the materials bearing petroleum, as a finely divided particulate homogeneous mass in the form of a layer of material into a vaporizing chamber in direct physical contact with linearly spaced flat reciprocating transporters made of magnetic-electrically susceptible material of substantial surface area;

(b) moving the layer of material through the vaporizing chamber in direct physical contact with said magnetically susceptible material;

(c) heating the magnetic-electrically susceptible material in the chamber by the transfer of energy through the magnetic component of an oscillating mid-to-high frequency electro-magnetic field to thereby correspondingly elevate the temperature of the said layer of material to its vaporizing temperature during the passage of the said layer through the chamber;

(d) controlling the intensity of the magnetic energy component of the said electro-magnetic field by simultaneous measurement of the temperature of the said thin layer of material as it enters and leaves the vaporizing chamber, and controlling the speed of travel of the said layer of material therethrough to vaporize substantially all of the desired hydrocarbons; and (e) recovering the vaporized hydrocarbons as a distillate.

3. The method according to claim 2 in which the vaporizing chamber is divided into a plurality of vaporizing zones, elevating the temperature of the thin layer of material as it moves through each zone to a temperature to vaporize the hydrocarbons one fraction at a time, commencing with the vaporization of the fraction having the lowest vaporizing temperature and ending with the fraction having the highest vaporizing temperature, and collecting each vaporized hydrocarbon fraction separately as a distillate.

4. The method according to claim 3 in which the thin layer of material is moved through successive vaporizing zones on transporters made from the magnetic-electrically susceptible material able to heat the transporters by the energy from the magnetic component of the said electro-magnetic field.

5. Apparatus for recovering hydrocarbons from solid materials bearing petroleum comprising:

(a) a support framework;

(b) a vaporizing chamber sealed against the admission of atmosphere thereto, the vaporizing chamber having a material inlet at one end and a discharge outlet at the opposite end for the discharge of coke coated particulate;

(c) a plurality of electrically heatable transporters for successively moving the material step-by-step through the vaporizing chamber from the inlet to the discharge outlet;

(d) a metering chamber sealed against the admission of atmosphere thereto and having means for shaping said material into a layer of substantially uniform thickness including metering means to successively deposit a uniform metered amount of the material on each transporter at the material inlet end;

(e) a chopper for breaking up the material and delivering it to the metering chamber;

(f) drive means for actuating the chopper, the metering means and the transporters;

(g) means for electrically heating said transporters to thereby heat said material during its passage through the vaporizing chamber to a temperature to vaporize the hydrocarbons of the petroleum bearing material, including means for controlling the temperature of the transporters in the vaporizing chamber;

(h) means for recovering the vaporized hydrocarbons; and (i) a receptacle at the discharge end to collect the coke coated particulate, said receptacle being sealed against the admission of atmosphere thereto during operation.

6. Apparatus for recovering hydrocarbons from solid materials bearing petroleum according to claim 5 wherein the transporters are alternately fixed and reciprocatable, the reciprocatable transporters overlapping the fixed transporters to form steps, the transporters being inclined from the inlet end to the outlet end at an angle of from 15° to 25° and said drive means reciprocates the reciprocatable transporter, whereby said material is transported step-by-step through the vaporizing chamber.

7. Apparatus according to claim 5 wherein the vaporizing chamber is divided into a plurality of vaporizing zones; and the means for heating the material consists of a separate heating means in each zone to vaporize one fraction of the hydrocarbons at a time, commencing with the fraction having the lowest vaporizing temperature and ending with the fraction having the highest temperature, and the means for recovering the vaporized hydrocarbons comprises a separate collector for each one of said zones, each collector communicating with only one of said zones, whereby the vapor generated in each zone is collected separately.

8. Apparatus according to claim 5 in which the transporters are formed of material susceptible to heating by electro-magnetic field induction, whereby said thin layer of material is heated to the vaporizing temperature of the hydrocarbons contained in the thin layer of the material and the electric means for heating comprises an electro-magnetic field induction system surrounding said transporters.

9. Apparatus according to claim 5 including an independent separately controlled electro-magnetic field for each vaporizing chamber and a separate heat control means for each said electro-magnetic field whereby the temperature of each zone is controlled at the appropriate vaporizing temperature and the means for recovering the distillate includes a separate means for collecting the vapors from each zone as a separate distillate (liquid and/or gas).

10. Apparatus according to claim 5 in which the vaporizing chamber is made of material that is not magnetically-electrically susceptible and the transporters are made of magnetic-electrically susceptible material and the means for electrically heating the transporters comprises means for generating an oscillating mid to high frequency electric magnetic field closely surrounding said vaporizing chamber and the transporters.

11. Apparatus for recovering hydrocarbons from petroleum bearing material according to claim 10 wherein the transporters are alternately fixed and reciprocatable, the transporters being stepped and inclined at an angle of from 15° to 25° from the horizontal, and means reciprocating the reciprocatable transporters, whereby said material is moved, step-by-step through the vaporizing chamber.

12. Apparatus according to claim 10 wherein the vaporizing chamber is divided into a plurality of vaporizing zones in tandem; and there is provided a separate means for heating the material as it passes through each zone to vaporize one fraction of the hydrocarbons at a time, commencing with the fraction having the lowest vaporizing temperature and ending with the fraction having the highest vaporizing temperature; and an independent separately controlled electro-magnetic induction system for each vaporizing chamber and a separate heat control means for each heating means whereby the temperature of each zone is controlled at the appropriate vaporizing temperature and the means for recovering the distillate includes separate means for collecting the vapors from each zone as a separate distillate.

13. Apparatus for recovering hydrocarbons from solid materials bearing petroleum comprising:

(a) a support framework;
(b) a vaporizing chamber sealed against the admission of atmosphere thereto and having a material inlet at one end and a discharge outlet at the opposite end for the discharge of a coke coated particulate;
(c) a plurality of electrically heatable transporters for successively moving said material step-by-step through the vaporizing chamber from the material inlet to the discharge outlet;
(d) a metering chamber sealed against the admission of atmosphere thereto and having means for shaping said material into a layer of substantial thickness including means to successively deposit a uniformly metered amount of the material on each transporter at the material inlet;
(e) a chopper for breaking up the material and delivering it to the metering chamber;
(f) drive means for actuating the chopper, the metering means and transporters;
(g) means for electrically heating said transporters to thereby heat said material during its passage through the vaporizing chamber to vaporize the hydrocarbons of the solid materials bearing petroleum including means for controlling the temperature of the transporters in the vaporizing chamber;
(h) means for recovering the vaporized hydrocarbons;
(i) a receptacle at the discharge end to collect the coke coated particulate, said receptacle being sealed against the admission of atmosphere thereto during operation.

14. Apparatus according to claim 13 wherein the vaporizing chamber is divided into a plurality of vaporizing zones; and the means for heating the material consists of a separate heating means in each zone to vaporize one fraction of the hydrocarbons at a time, commencing with the fraction having the lowest vaporizing temperature and ending with the fraction having the highest temperature, and the means for recovering the vaporized hydrocarbons comprises a separate collector for each one of said zones, each collector communicating with only one of said zones, whereby the vapor generated in each zone is collected separately.

15. Apparatus for recovering hydrocarbons from solid materials bearing petroleum comprising:

(a) a support framework;
(b) a chopper for breaking up the material;
(c) a metering compartment having means for shaping said material into a substantially thin blanket;
(d) a vaporizing chamber having an inlet at one end and an outlet at the opposite end, said chamber being made of material that is not magnetically-electrically susceptible;
(e) a plurality of transporters within the chamber for moving said material step-by-step through the vaporizing chamber; said transporters being made of magnetic-electrically susceptible material of substantial surface area to directly contact the said material;
(f) means for depositing a measured amount of said thin blanket on each transporter;
(g) drive means for actuating said transporters and said chopper;
(h) electric means for generating an oscillating mid-to-high frequency electric magnetic field closely surrounding said vaporizing chamber and said transporters;
(i) electro-mechanical means for controlling the temperature at the vaporizing temperature; and
(j) means for recovering the vapors as a distillate.

* * * * *